United States Patent [19]

Hjelm

[11] 3,995,756

[45] Dec. 7, 1976

[54] LOAD HANDLING APPARATUS

[75] Inventor: Odd Werner Hjelm, Eldsberga, Sweden

[73] Assignee: Foralkranar AB, Helsingborg, Sweden

[22] Filed: July 21, 1975

[21] Appl. No.: 597,745

[52] U.S. Cl. ..... 214/147 T; 214/1 BC; 214/1 BD; 214/DIG. 10

[51] Int. Cl.[2] ..... B66C 1/22

[58] Field of Search ..... 214/1 B, 1 BB, 1 BC, 214/1 BD, 1 BH, 1 BV, 147 T, 147 R, 151, DIG. 10, 1 CM

[56] References Cited

UNITED STATES PATENTS

| | | | |
|---|---|---|---|
| 2,948,417 | 8/1960 | Haanes | 214/1 BD |
| 3,040,685 | 6/1962 | Ridley | 214/1 BD |
| 3,061,118 | 10/1962 | Halberstadt | 214/DIG. 10 |
| 3,127,026 | 3/1964 | Blatt | 214/1 BD |
| 3,268,092 | 8/1966 | Hainer et al. | 214/1 CM |
| 3,703,968 | 11/1972 | Uhrich et al. | 214/147 T |

*Primary Examiner*—Robert S. Ward, Jr.
*Attorney, Agent, or Firm*—Beveridge, DeGrandi, Kline & Lunsford

[57] ABSTRACT

A load handling apparatus including a frame, an apparatus head mounted on the frame and rotatable in a horizontal plane and an arm mounted on the apparatus head. The arm has an inner portion which is in the form of a parallelogram linkage with two parallel longitudinal links which are swingable in a vertical plane relative to the apparatus head and are connected by joints, at their ends, to an outer transverse link and an inner transverse link parallel thereto. The arm also has an outer portion which is an extension of the transverse outer link of the inner portion and supports, at its outer extremity, a holder for a load. The joint between the inner transverse link and a first of the longitudinal links is adjustable in a vertical direction by shifting relative to the apparatus head. The second of the longitudinal links has a follower which is spaced from the joint associated with the inner transverse link, is guided to follow a horizontal path once the arm is swung and is located on a straight line through the outer extremity of the outer portion and the adjustable joint.

11 Claims, 2 Drawing Figures

LOAD HANDLING APPARATUS

BACKGROUND OF THE INVENTION

This invention relates to a load handling apparatus comprising a frame, an apparatus head mounted on the frame and rotatable in a horizontal plane, and an arm mounted on the apparatus head. The arm has an inner portion which is in the form of a parallelogram linkage with two parallel longitudinal links which are swingable in a vertical plane relative to the apparatus head and are connected by joints, at their ends, to an outer transverse link and an inner transverse link parallel thereto. The arm also has an outer portion which includes an extension of the outer transverse link of the inner portion and supports, at its outer extremity, a holder for a load.

With prior art apparatuses of this type it has not been possible to carry out, in a simple manner, an accurate horizontal translation of the load. Furthermore, the prior art apparatuses utilise drives actuating the arm for raising and lowering of the load. These drives usually include chains or the like, and, because of this, do not permit a gentle start and stop of the movement of the load. Finally, the prior art apparatuses utilise springs for balancing the arm, but these springs often provide poor balancing. With heavy loads, moreover, dangerous return forces arise in the extreme positions of the arm. It is also necessary to employ counterweights located outside the apparatus head which impedes the movement of the apparatus.

SUMMARY OF THE INVENTION

The object of the present invention is to obviate the disadvantages inherent in the prior art apparatuses. To this end, the apparatus comprises means for adjusting the joint between the inner transverse link and a first of the longitudinal links relative to the apparatus head by shifting said joint in a substantially vertical direction; a follower arranged on the second of the longitudinal links and spaced from the joint associated with the inner transverse link; and means for guiding the follower along a substantially horizontal path once the arm is swung, the follower being located on a straight line through the outer extremity of the outer portion and the adjustable joint.

DESCRIPTION OF THE PREFERRED EMBODIMENT

Figure 1:
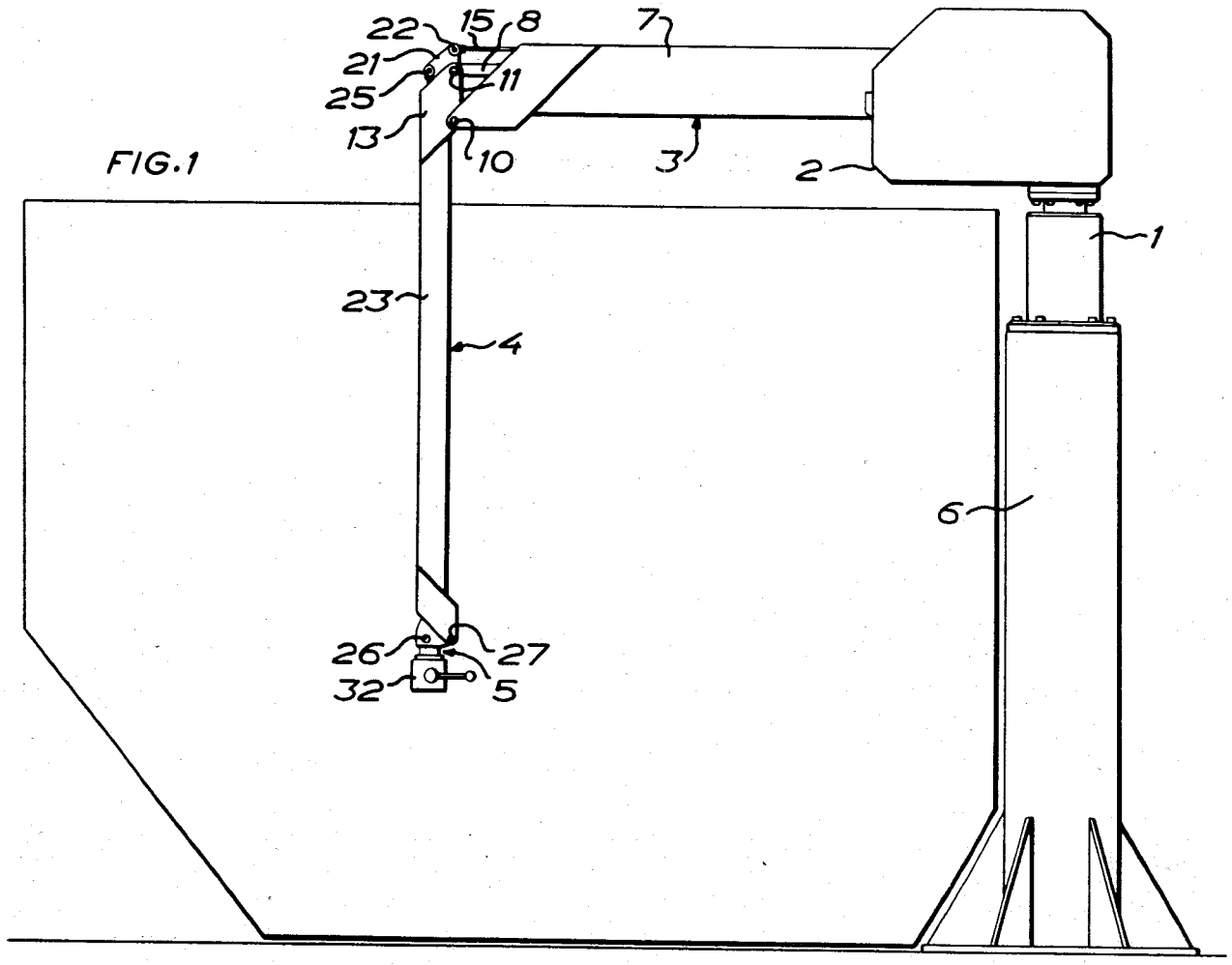
FIG. 1 is a side elevation of an embodiment of the invention.

The load handling apparatus according to the present invention comprises a frame 1, an apparatus head 2, an arm with an inner portion 3 and an outer portion 4, and a holder 5. In FIG. 1, the frame 1 is mounted on an upright 6 fixedly attached to the floor, but the frame can also be wall-mounted or ceiling-mounted. Of course, the frame 1 can also be mobile, for example, disposed on some form of vehicle.

The apparatus head 2 is mounted so as to be rotatable in a horizontal plane on the frame 1 by means of a thrust bearing (not shown) and supports the inner portion 3 of the arm in such a manner that said portion is pivotable in a vertical plane relative to the apparatus head 2. The outer extremity of the inner portion 3 is connected to the inner extremity of the outer portion 4, while the outer extremity of the outer portion 4 is connected to the holder 5.

Figure 2:
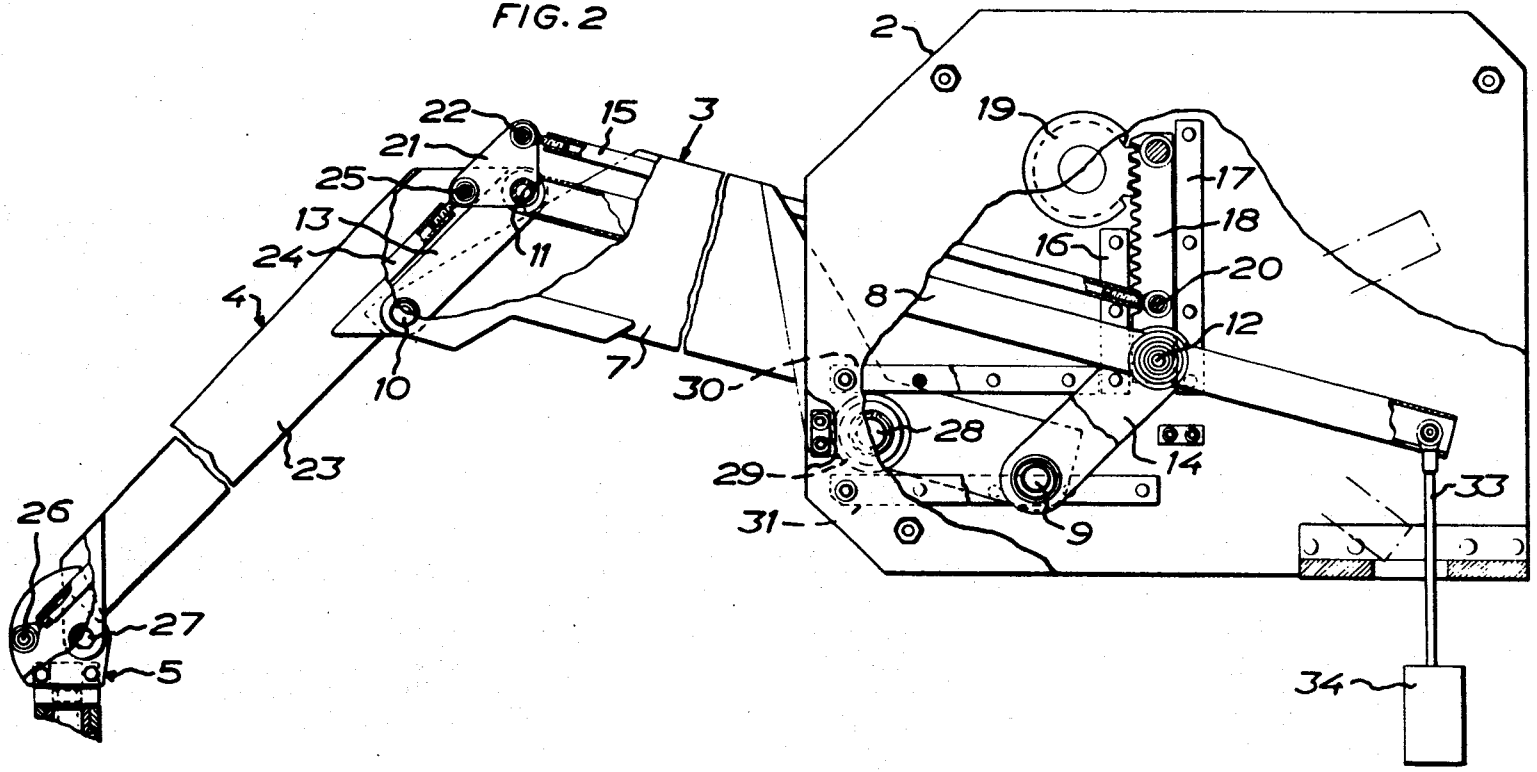
FIG. 2 schematically illustrates certain details of the embodiment shown in FIG. 1.

As shown in greater detail in FIG. 2, the inner portion 3 of the arm is in the form of a parallelogram linkage which comprises two parallel longitudinal links 7 and 8 connected, by joints 9-12, at their ends to an outer transverse link 13 and an inner transverse link 14 parallel thereto. The link 7 is in the form of a tube surrounding the link 8 and a link 15 parallel thereto. The joint 12 between the links 8 and 14 is mounted on a rack 18 which is vertically shiftable between two guide rails 16 and 17. The rack is in mash with a gear wheel 19 which can be driven by an electric motor M (FIG. 1) via a belt transmission (not shown) for shifting the rack 18. The use of belt transmission ensures a gentle movement of the apparatus free from jerks. A joint 20 for the inner end of the link 15 is mounted on the rack 18 vertically above the joint 12. The outer end of the link 15 is coupled to a connecting member 21 by means of a joint 22, the joint 11 being mounted in the connecting member 21 vertically below the joint 22.

The outer portion 4 of the arm comprises an extension 23 of the transverse link 13 and a link 24 parallel thereto which is coupled by means of joints 25 and 26 to the connecting member 21 and the holder 5, respectively. The joints 11, 25, 26 and the joint 27 connecting the holder 5 to the extension 23, together make up the four corners of a parallelogram, for which reason the direction of the holder 5 is fixed and independent of the position of the arm relative to the apparatus head 2. The extension 23 is in the form of a tube surrounding the link 24.

The center of a shaft 28 mounted on the link 7 transversely of the plane of pivotment of the arm is located on a straight line between the center of the joint 12 and the center of the joint 27. A roller 29 is rotatably mounted on each end of the shaft 28, the rollers 29 being guided between their respective pair of horizontal guide rails 30 and 31 fixedly attached in the apparatus head 2.

As a result of the fact that the apparatus, because of its construction, operates on the known principle of a pantograph, the joint 27 and the holder 5, together with the load carried by said holder, will execute a horizontal translatory motion, on manual shifting of the holder 5 and with the rack 18 being held in fixed position. As a result of the same principle, the holder 5 will execute vertical translatory motion when the rack 18 and thus the joint 12 are shifted by the motor via the belt transmission and the gear wheel 19, provided that the rollers 29 remain stationary.

A rack pivoted to the link 7 can be substituted for the shaft 28 and the rollers 29 which make up a follower, said rack being shiftable between the guide rails 30 and 31 by a second motor via a second belt transmission and a second gear wheel.

The holder 5 is fitted with an operating means 32 for the motor or motors mounted on the apparatus head 2. The holder 5 can be fitted with a number of different, exchangeable gripping members for holding different loads.

For balancing the arm, the longitudinal link 8 is extended beyond the joint 12 and is connected, at its innermost end, to a rod 33 which supports a suitably adapted counterweight 34. The joint 12 being separated from the axis of rotation of the apparatus head 2, it is possible to balance the arm almost totally with the counterweight 34, the position of which substantially coincides with said axis and which, thereby, does not hinder the movements of the apparatus in any way.

In certain cases it may be necessary to prevent a load from being shifted past a certain level. This can be achieved by means of limit switches which are actuated in response to the position of the rack 18 relative to the guide rails 16 and 17.

In cases where the follower also is a motor-driven rack, the horizontal shifting of the load can also be restricted to a predetermined range. It is, of course, also possible, with the help of limit switches, to preselect different positions between which the handling apparatus, on activation, automatically shifts the load. By this means, very rapid and accurate movements of the loads can be achieved.

What I claim and desire to secure by Letters Patent is:

1. In a load handling apparatus comprising a frame, an apparatus head mounted on said frame and rotatable in a horizontal plane, and an arm mounted on the apparatus head, said arm having an inner portion in the form of a parallelogram linkage with two parallel longitudinal links which are swingable in a vertical plane relative to said apparatus head and are connected by joints at their ends, to an outer transverse link and an inner transverse link parallel thereto, and said arm having an outer portion including an extension of the outer transverse link of the inner portion and supporting, at its outer extremity, a holder for a load, the improvement comprising means for adjusting the joint between the inner transverse link and a first of said longitudinal links relative to said apparatus head by shifting said joint in a substantially vertical direction; a follower spaced from the joint associated with the inner transverse link and arranged on the second of said longitudinal links; and means for guiding said follower along a substantially horizontal path once the arm is swung, said follower being located on a straight line through the outer extremity of the outer portion and the adjustable joint.

2. An apparatus according to claim 1, wherein the follower is at least one roller rotatably mounted on said second longitudinal link, and wherein the guiding means are two horizontal guide rails fixedly mounted on the apparatus head, said rollers running between said guide rails.

3. An apparatus according to claim 2, wherein the adjusting means include two vertical guide rails fixedly attached to said apparatus head, a rack which is shiftable between the vertical guide rails and on which is fixed the adjustable joint, and a gear wheel driven by a motor and in mesh with said rack.

4. An apparatus according to claim 3, further comprising a belt transmission to connect said motor to said gear wheel.

5. An apparatus according to claim 4, wherein an operating means for said motor is mounted on said holder.

6. An apparatus according to claim 1, wherein the follower is a rack rotatably connected to said second longitudinal link, the guide means are two horizontal guide rails fixedly attached to said apparatus head and between which the rack is shiftable, and a motor-driven gear wheel is in mesh with said rack.

7. An apparatus according to claim 1, wherein said first longitudinal link has an extension which projects beyond the adjustable joint and supports, at its outer extremity, a counterweight balancing the arm.

8. An apparatus according to claim 7, wherein the inner portion of said arm is mounted in such a manner relative to the axis of rotation of the apparatus head that the position of the counterweight essentially coincides with said axis.

9. An apparatus according to claim 1, further comprising a link parallel to said extension of said outer transverse link and forming, together with the extension, the holder and a connecting member at the inner end of said outer portion, a second parallelogram linkage; and a link parallel to said first longitudinal link and forming, together with said first longitudinal link, said connecting member and a directionally fixed transverse link at the inner end of said first longitudinal link, a third parallelogram linkage, whereby the holder is directionally fixed.

10. An apparatus according to claim 9, wherein said second longitudinal link is in the form of a tube surrounding said first longitudinal link and said link parallel thereto, and wherein the extension of said outer transverse link is in the form of a tube surrounding the link parallel to said extension.

11. An apparatus according to claim 1, wherein at least one limit switch is arranged to co-operate with the adjusting and guide means to stop the movement of the load at a preselected position.

* * * * *